US007942142B2

(12) United States Patent
Gobright, IV

(10) Patent No.: US 7,942,142 B2
(45) Date of Patent: May 17, 2011

(54) BATTERY POWERED CONCRETE SAW

(76) Inventor: Francis M. Gobright, IV, Howell, MI (US)

( * ) Notice: Subject to any disclaimer, the term of this patent is extended or adjusted under 35 U.S.C. 154(b) by 670 days.

(21) Appl. No.: 11/924,896

(22) Filed: Oct. 26, 2007

(65) Prior Publication Data

US 2009/0107476 A1 Apr. 30, 2009

(51) Int. Cl.
*B28D 1/24* (2006.01)

(52) U.S. Cl. ..... 125/13.01; 125/13.03

(58) Field of Classification Search ..... 125/13.01, 125/13.03, 38
See application file for complete search history.

(56) References Cited

U.S. PATENT DOCUMENTS

| | | | | |
|---|---|---|---|---|
| 2,468,336 | A | 4/1949 | Lewis | |
| 4,175,788 | A | 11/1979 | Jacobson et al. | |
| 4,767,162 | A | 8/1988 | Reed, III | |
| 4,824,516 | A | 4/1989 | Ishihara et al. | |
| 4,840,431 | A * | 6/1989 | Jedick | 299/39.3 |
| 4,938,201 | A * | 7/1990 | Chiuminatta et al. | 125/13.01 |
| 4,998,775 | A * | 3/1991 | Hollifield | 299/39.3 |
| 5,104,195 | A | 4/1992 | Zaccho | |
| 5,381,780 | A * | 1/1995 | Yelton et al. | 299/39.3 |
| 5,809,985 | A * | 9/1998 | Kingsley et al. | 125/13.01 |
| 5,810,448 | A | 9/1998 | Kingsley et al. | |
| 6,019,433 | A * | 2/2000 | Allen | 299/39.3 |
| 6,102,022 | A | 8/2000 | Schave | |
| 6,390,086 | B1 * | 5/2002 | Collins et al. | 125/13.01 |
| 6,484,711 | B2 * | 11/2002 | Acker et al. | 125/13.01 |
| 6,935,703 | B1 * | 8/2005 | Gobright, IV | 299/39.3 |
| 6,981,494 | B1 * | 1/2006 | Bowman | 125/13.01 |
| 7,000,605 | B2 | 2/2006 | Due | |
| 7,222,618 | B2 * | 5/2007 | Galambos et al. | 125/13.01 |
| 7,487,770 | B2 * | 2/2009 | Johnson et al. | 125/13.03 |
| 2002/0117160 | A1 | 8/2002 | Acker et al. | |
| 2003/0168054 | A1 | 9/2003 | Governo et al. | |
| 2007/0164598 | A1 | 7/2007 | Johnson et al. | |
| 2010/0006082 | A1 * | 1/2010 | Glinski et al. | 125/16.02 |

* cited by examiner

*Primary Examiner* — Maurina Rachuba
(74) *Attorney, Agent, or Firm* — Brooks Kushman P.C.

(57) ABSTRACT

A concrete saw (10) has an electric motor (24) energized by a battery pack (34) to drive a pair of saw arbors (42) and a battery powered transmission (30) drives rear wheels (16) that provide self propulsion of the saw in cooperation with front wheels (20). A power operated actuator (54) raises and lowers the front wheels (20) to provide upward and downward movement of the saw frame (14) about its rear wheels (16). The battery pack (34) may be lead acid batteries, nickel-cadmium batteries, nickel metal hydride batteries or lithium batteries, and the electric motor (24) has 5 to 15 horsepower, preferably about 10 horsepower, to provide cutting of most conventional concrete jobs.

19 Claims, 2 Drawing Sheets

BATTERY POWERED CONCRETE SAW

BACKGROUND OF THE INVENTION

1. Field of the Invention

This invention relates to a battery powered concrete saw for cutting concrete, asphalt and the like, etc.

2. Background Art

Saws for cutting concrete, asphalt and the like, etc. are conventionally electrically powered or powered by an internal combustion engine that utilizes gasoline or diesel fuel, the latter of which cannot be used indoors due to the exhaust generated. When concrete saws are powered by electricity, an internal combustion engine generator is conventionally used because 240 or 480 volt 3 phase power is required to operate concrete saws of about 5 horsepower or more. However, when indoor cutting is required, the generator due to the exhaust generated must be operated outside and the time required to run an electrical line, which often is hundreds of feet and/or up a number of stories, can be prohibitedly expensive.

U.S. Pat. No. 7,000,605 Due discloses a concrete engraver apparatus and method that is normally operated through a power cord that appears in the drawings to be house type 110 volt, but is also disclosed as using a battery pack. This engraver is manually moved much like a carpet vacuum cleaner and does not appear to be sufficiently heavy duty to permit use in heavy duty concrete cutting jobs.

U.S. Pat. No. 4,998,775 Hollifield discloses an apparatus for precision cutting of concrete surfaces that utilizes a battery for powering a self-powered vehicle supported by a pair of spaced tracks. The necessity for spaced tracks for such a concrete cutter would result in any cutting job also being prohibitedly expensive.

Other prior art noted during an investigation conducted for the present invention included U.S. Pat. No. 4,175,788 Jacobson et al.; U.S. Pat. No. 4,767,162 Reed, III; U.S. Pat. No. 4,824,516 Ishihara et al.; and U.S. Pat. No. 6,102,022 Schave.

SUMMARY OF THE INVENTION

An object of the present invention is to provide an improved concrete cutting saw.

In carrying out the above object, a concrete cutting saw constructed in accordance with the present invention includes a frame having a pair of rear wheels and a pair of front wheels for facilitating movement of the saw to different locations for use and for movement during a cutting operation. An electric motor of the saw is of at least 5 horsepower and is mounted by the frame. The frame also has a mounting arrangement for supporting a battery pack for operating the electric motor. A battery powered transmission drives the rear wheels to provide self-propulsion of the saw. A pair of saw arbors are respectively mounted for rotation on opposite lateral sides of the frame forward of the pair of front wheels, and the saw arbors have a rotational connection to the electric motor to provide rotational driving of the saw arbors for cutting. An actuator moves the front wheels upwardly and downwardly with respect to the frame to pivot the frame about the rear wheels between an upper idle position and a lower use position that permits cutting of concrete or the like with a saw blade mounted on one of the arbors.

A battery pack is mounted by the frame to power the electric motor. The battery pack may be lead acid batteries, nickel-cadmium batteries, nickel metal hydride batteries or lithium batteries, and the electric motor preferably has about 5 to 15 horsepower, most preferably about 10 horsepower.

The preferred transmission is a hydraulic transmission that drives the pair of rear wheels from the electric motor that also drives the saw arbors.

As disclosed, the actuator for moving the frame upwardly and downwardly is power operated. This power operated actuator includes a hydraulic cylinder for pivoting the frame between the upper idle position and the lower use position, a hydraulic pump that operates the hydraulic cylinder, and a second electric motor that powers the hydraulic pump. The second electric motor has an electrical connection for powering by the battery pack supported by the frame mounting arrangement.

The concrete saw also includes a front guide assembly including a V-shaped guide member pivotally mounted on the frame for movement between a forwardly projecting use position and a generally vertically extending storage position. A guide wheel on the vertex of the V-shaped guide member rolls along the surface being cut and provides guiding of the saw with the guide member in the forwardly projecting use position.

The concrete saw also includes a pair of blade guards respectively associated with the pair of saw arbors to provide protection from a saw blade mounted on either arbor.

The objects, features and advantages and of the present invention are readily apparent from the following detailed description of the preferred embodiment when taken in connection with the accompanying drawings.

DETAILED DESCRIPTION OF THE PREFERRED EMBODIMENT

Figure 1:
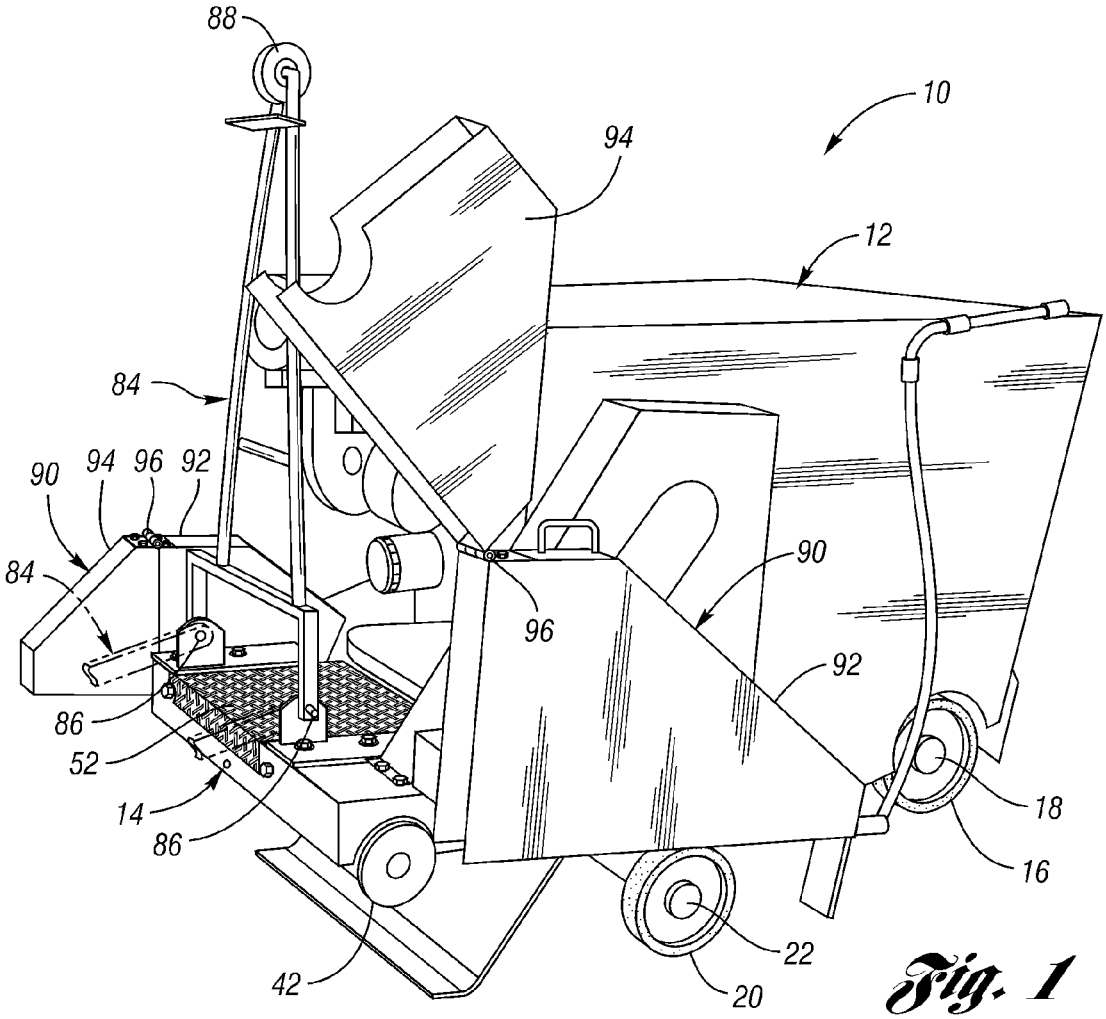
FIG. 1 is a perspective view of a concrete cutting saw constructed in accordance with the present invention.
Figure 3:
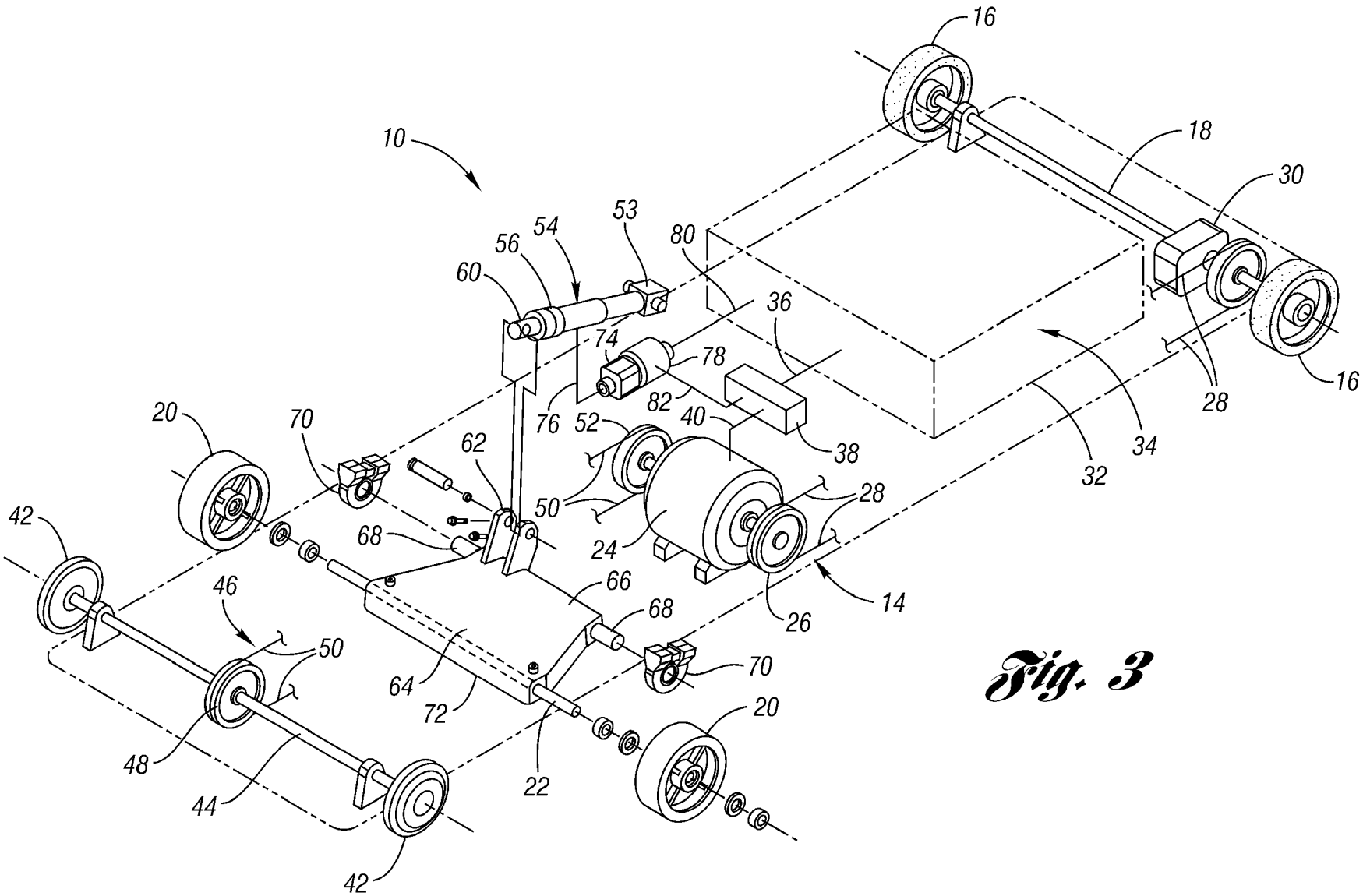
FIG. 3 is a broken away perspective view of the concrete saw showing its components which provide the concrete cutting operation.

With reference to FIG. 1 of the drawings, a concrete saw 10 is constructed to cut concrete, asphalt and the like as is hereinafter more fully described. This concrete saw includes a housing 12 that may be fabricated from sheet metal or molded plastic, etc. The concrete saw 10 as shown in FIG. 3 includes a frame 14 having a pair of rear wheels 16 that are supported by an axle 18 on the frame. A pair of front wheels 20 are also supported on the frame by an axle 22 as is hereinafter more fully described. The rear wheels 16 and front wheels 20 cooperate to facilitate movement of the concrete saw 10 to different locations for use and for movement during a cutting operation.

As shown in FIG. 3, an electric motor 24 is mounted on the frame 14 and has a rotary output 26 that drives a belt or chain 28 which drives a rotary input 29 to a hydrostatic transmission 30 that drives the rear wheel axle 18 to provide self propulsion of the saw during transport between cutting locations and during any cutting operation. The frame 14 also has a mounting arrangement 32 for supporting a battery pack 34 which has a connection 36 to a controller 38 that has a connection 40 to the electric motor 24 so as to provide controlled powering of the electric motor. This electric motor controlling has a variable speed with overload protection so cutting can be performed at the desired speed without motor damage.

With continuing reference to FIG. 3, the concrete saw 10 also includes a pair of saw arbors 42 respectively mounted on the frame 14 by a shaft 44 at opposite lateral sides of the saw so that concrete cutting can be performed closely adjacent the saw at either of its sides. A rotational connection 46 for the saw arbors includes a pulley or sprocket 48 on the shaft 44, a belt or chain 50 trained over the pulley or sprocket 48 and another output 52 on the electric motor that drives the belt or chain 50 to provide rotation of the saw arbors 42 for cutting.

As also shown in FIG. 3, an actuator collectively indicated by 54 is disclosed as being power operated and pivots the front wheel axle 52 to provide raising and lowering of the front wheels 20. Such movement pivots the front end of the frame 14 upwardly and downwardly about the rear wheels 16 and moves the saw arbors 42 and any saw blade 55 supported thereby between the upper idle position shown by solid line representation in FIG. 2 and the lower cutting position shown by phantom line representation, as is hereinafter more fully described. It should be appreciated that the actuator while preferable being power operated can also be hand operated.

As shown in FIG. 3, the battery pack 34 is supported by the mounting arrangement 32 on the frame 14 in any suitable manner. This battery pack may be more conventional lead acid batteries, nickel-cadmium batteries, nickel metal hydride batteries or lithium batteries.

The electric motor 24 that drives the rear wheel transmission 30 and the saw arbors 42 through the rotational connection 46 preferably has about 5 to 15 horsepower to provide sufficient power for most conventional concrete requiring cutting. More specifically, when fresh green concrete is being cut, a less powerful electric motor of about 5 horsepower can be sufficient. For cutting aged thick concrete with reinforcing steel bars, a more powerful electric motor is needed, but electric motors having more than about 15 horsepower can draw so much current that the battery life will be unduly shortened. Electric motors with about 10 horsepower are believed to provide a good compromise of having sufficient cutting power without drawing too much current. More specifically, experimentation has indicated that an electric motor of about 10 horsepower that is powered by a battery pack including twelve six volt lead acid batteries connected in series for a total of 72 volts is capable of cutting for about one hour and thirty minutes through six inch thick aged concrete with ⅝ inch diameter reinforcing bars every foot and can cut for about 80 feet while drawing an average current of about 100 amperes, as high as about 150 amperes when cutting through the reinforcing bars and down to about 80 amperes when just cutting the concrete. Of course, improvements in battery technology may permit the use of higher horsepower electric motors in the future while maintaining an adequate charge time.

The power operated actuator 54 of the saw as shown in FIG. 3 includes a hydraulic cylinder 56 having one end 58 that is secured in a suitable manner to the frame and having another end 60 that has a pivotal connection 62 to a front axle mount 64 whose rear end 66 is supported by stub shafts 68 by bearings 70 on frame 14 and whose front end 72 supports the front wheel axle 22. A hydraulic pump 74 has a fluid connection 76 to the cylinder 56 and is rotatively driven by a second electric motor 78 which has a power connection 80 to the battery pack 34. Control 38 has a control connection 82 to the electric motor 78 to control its operation and hence the operation of the hydraulic pump 74. Extension of the cylinder 56 pivots the front end 72 of the front axle mount 64 downwardly to raise the front end of the frame 14 as it pivots about the rear wheels 16 and thereby moves the saw upwardly from the lower cutting position shown by phantom line representation in FIG. 2 to the upper idle position shown by solid line representation. Retraction of the cylinder 56 raises the front wheels 20 with respect to the frame 14 to lower the front end of the frame and thereby move the saw blade downwardly from its upper idle position to its lower cutting position.

As shown in FIG. 1, the concrete saw also includes a V-shaped guide member 84 having a pivotal connection 86 to the machine frame 14 for movement between a forwardly protecting use position shown by partially phantom line representation and a generally vertically extending storage position. A guide wheel 88 on the vertex of the V-shaped guide member 84 rolls along the surface being cut with the guide member in the forwardly projecting use position and provides guiding of the saw.

Figure 2:
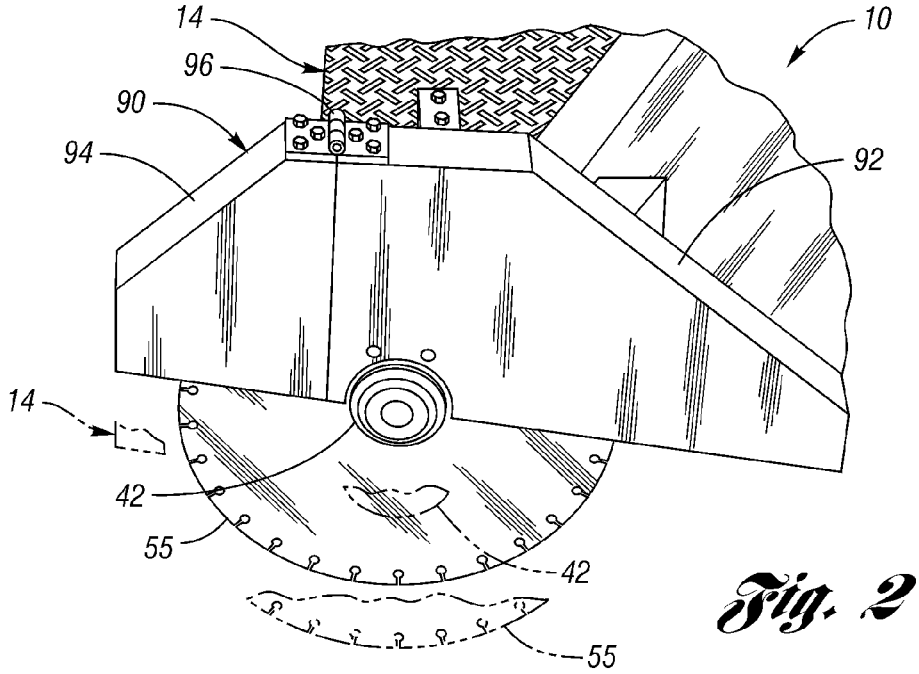
FIG. 2 is a partial view of the saw shown in a solid line indicated upper idle position and a partial phantom line indicated lower cutting position.

As shown in FIGS. 1 and 2, the saw 10 also includes a pair of blade guards 90 respectively associated with the pair of blade arbors 42 to provide protection from any rotating blade. These blade guards 90 may be removable mounted and as disclosed each includes a rear portion 92 and a front portion 94 that is mounted by a hinge 96 for movement between a forwardly projecting use position and an upwardly projecting open position.

While an embodiment of the invention has been illustrated and described, it is not intended that this embodiment illustrates and describes all possible forms of the invention. Rather, the words used in the specification are words of description rather than limitation, and it is understood that various changes may be made without departing from the spirit and scope of the invention.

What is claimed is:

1. A concrete saw comprising:

a frame having a pair of rear wheels and a pair of front wheels for facilitating movement of the saw to different locations for use and for movement during a cutting operation;

a first electric motor mounted by the frame and being operably connectable to a battery pack for receiving power therefrom, a battery powered transmission for connecting the first electric motor to driving the rear wheels to provide self-propulsion of the saw;

a pair of saw arbors respectively mounted for rotation on opposite lateral sides of the frame forward of the pair of front wheels, and the saw arbors having a rotational connection to the first electric motor to provide rotative driving thereof; and a power actuator including a hydraulic cylinder for moving the front wheels upwardly and downwardly with respect to the frame to pivot the frame about the rear wheels between an upper idle position and a lower use position that permits cutting of concrete or the like with a saw blade mounted on one of the arbors, a hydraulic pump that operates the hydraulic cylinder, and a second electric motor being powered from the battery pack for driving the hydraulic pump.

2. A concrete saw as in claim 1 wherein the battery pack is of a type selected from the group consisting of lead acid batteries, nickel-cadmium batteries, nickel metal hydride batteries, and lithium batteries.

3. A concrete saw as in claim 1 wherein the first electric motor has about 5 to 15 horsepower.

4. A concrete saw as in claim 3 wherein the first electric motor has about 10 horsepower.

5. A concrete saw as in claim 1 wherein the transmission comprises a hydraulic transmission that drives the pair of rear wheels.

6. A concrete saw as in claim 1 further including a front guide assembly including a V-shaped guide member pivotally mounted on the frame for movement between a forwardly projecting use position and a vertically and rearwardly extending storage position, and a guide wheel on the vertex of the V-shaped guide member for rolling along the surface being cut and providing guiding of the saw with the guide member in the forwardly projecting use position.

7. A concrete saw as in claim 1 further including a pair of blade guards respectively associated with the pair of saw arbors to provide protection from a saw blade mounted on either arbor.

8. A concrete saw as in claim 1 further including a front guide assembly including a V-shaped guide member pivotally mounted on the frame for movement between a forwardly projecting use position and a vertically and rearwardly extending storage position, a guide wheel on the vertex of the V-shaped guide member for rolling along the surface being cut and providing guiding of the saw with the guide member in the forwardly projecting use position, and a pair of blade guards respectively associated with the pair of saw arbors to provide protection from a saw blade mounted on either arbor.

9. A concrete saw of claim 1 further including a controller being operably connectable to the battery pack for controlling the powering of the first electric motor.

10. A concrete saw of claim 9 wherein the controller is further configured to disable the powering of the first electrical motor in the event an overload condition is detected.

11. A concrete saw comprising:

a frame having at least one rear wheel and at least one front wheel for facilitating movement of the saw to different locations for use and for movement during a cutting operation;

an electric motor mounted on the frame;

a battery pack mounted on the frame for powering the electric motor;

a transmission being operably coupled to the battery pack for connecting the electric motor to drive the at least one rear wheel to provide self-propulsion of the saw; and at least one arbor mounted for rotation about the frame, each of the arbors having a saw blade mounted thereon, and the at least one arbor having a rotational connection to the electric motor to provide rotative driving thereof.

12. A concrete saw of claim 11 further including a controller being positioned on the frame and operably coupled to the battery pack for controlling the powering of the electric motor.

13. A concrete saw of claim 12 wherein the controller is further configured to disable the powering of the electrical motor in the event an overload condition is detected.

14. A concrete saw of claim 11 further comprising an actuator including a second electric motor for moving the at least one front wheel upwardly and downwardly with respect to the frame to pivot the frame about the at least one rear wheel between an upper idle position and a lower use position that enables cutting of concrete or the like with the saw blade.

15. A concrete saw of claim 14 further comprising a controller being operably coupled to the battery pack and the second electric motor for controlling powering of the second electric motor.

16. A concrete saw comprising:

a frame having at least one rear wheel and at least one front wheel for facilitating movement of the saw to different locations for use and for movement during a cutting operation;

an electric motor mounted on the frame;

a battery pack for powering the electric motor;

a transmission being operably coupled to the battery pack for connecting the electric motor to drive the at least one rear wheel to provide self-propulsion of the saw;

at least one arbor mounted for rotation about the frame, each of the arbors having a saw blade mounted thereon, and the at least one arbor having a rotational connection to the electric motor to provide rotative driving thereof; and a controller being operably coupled to the battery pack to control the powering of the electric motor and to disable the powering of the electrical motor in the event an overload condition is detected.

17. A concrete saw of claim 16 further comprising an actuator including a second electric motor for moving the at least one front wheel upwardly and downwardly with respect to the frame to pivot the frame about the at least one rear wheel between an upper idle position and a lower use position that enables cutting of concrete or the like with the saw blade.

18. A concrete saw of claim 17 wherein the controller is further configured to control powering of the second electric motor.

19. A concrete saw of claim 16 wherein the battery pack is mounted to the frame.

* * * * *